United States Patent [19]

Boller et al.

[11] Patent Number: 4,854,509

[45] Date of Patent: Aug. 8, 1989

[54] METHOD AND DEVICE FOR INTERMITTENTLY STORING AND RETURNING YARN DURING THE WINDING OF CONICAL BOBBINS FED WITH YARN AT CONSTANT SPEED

[75] Inventors: Giorgio Boller, Treviso; Francesco Ferro; Luigi Colli, both of Pordenone, all of Italy

[73] Assignee: Savio, S.p.A., Pordenone, Italy

[21] Appl. No.: 169,317

[22] Filed: Mar. 17, 1988

[30] Foreign Application Priority Data

Mar. 19, 1987 [IT] Italy ..... 19757 A/87

[51] Int. Cl.[4] ..... B65H 54/06; B65H 54/10

[52] U.S. Cl. ..... 242/18 R; 242/18 DD; 242/154

[58] Field of Search ..... 242/18 R, 18 DD, 45, 242/147 R, 153, 154, 25 R

[56] References Cited

U.S. PATENT DOCUMENTS

| | | | |
|---|---|---|---|
| 3,231,216 | 1/1966 | Lemarchand | 242/150 R |
| 3,640,477 | 2/1972 | Furst | 242/18 DD X |
| 4,002,306 | 1/1977 | Raasch | 242/18 DD X |
| 4,083,506 | 4/1978 | Mander et al. | 242/25 R |
| 4,113,193 | 9/1978 | Raasch et al. | 242/18 DD X |
| 4,133,493 | 1/1979 | Schewe | 242/154 |
| 4,312,482 | 1/1982 | Schewe | 242/154 |

FOREIGN PATENT DOCUMENTS 2337094 7/1977 France .

*Primary Examiner*—Stanley N. Gilreath

*Attorney, Agent, or Firm*—Hedman, Gibson, Costigan & Hoare

[57] ABSTRACT

A device and method for winding conical bobbins with yarn withdrawn at constant speed from individual spinning units, and comprising: a deflecting roller or similar element, which is connected to and moved backwards and forwards by a swinging flat element for yarn storage and accumulation, to compensate the variation in the speed at which the yarn is collected on the conical surface of the bobbin under formation wherein yarn is drawn into the storage position and is then released from this storage position, (i.e. returned). This returning operation releases the yarn from its storage position and replaced it (returns it), to is normal feed path; an electronic or similar yarn tension measurer of known type for measuring the tension values of the yarn being wound and to generate electrical signals proportional to said values; an electrical comparator for comparing said electrical signals with one or more reference signals to generate a control signal when an electrical signal arises which indicates a non-regular yarn tension; an electronic control unit for converting said control signal into a signal which varies the amplitude of the swing motion of a drive source; a drive source which increases or decreases the amplitude of its intermittent drive motion in order to adjust the swing movement of the storage arm to an amplitude which is slightly greater or slightly less than the previous value in order to rapidly restore the yarn tension to within the range of values corresponding to regular tension.

3 Claims, 1 Drawing Sheet

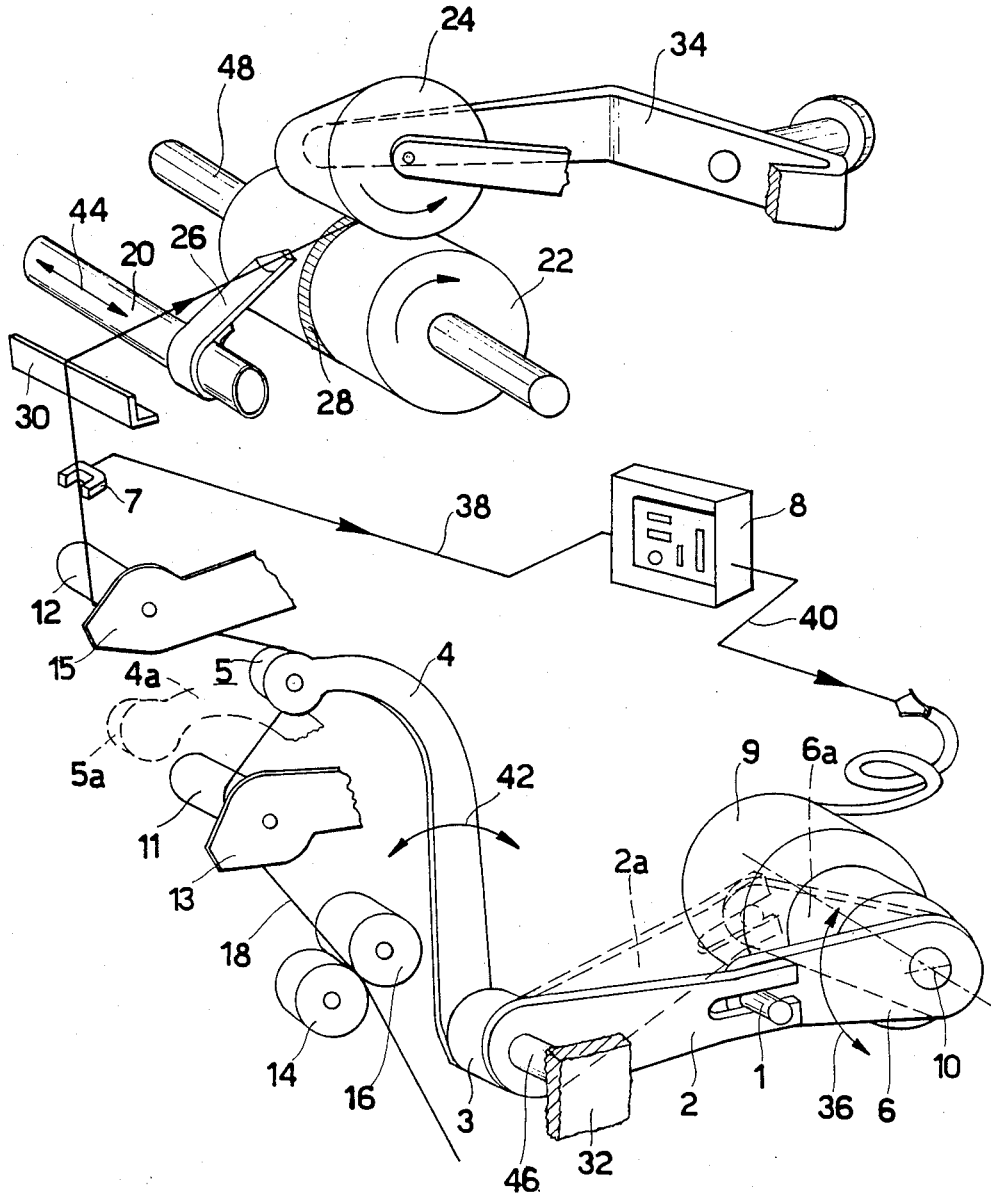
24
34
48
44
20
26
22
30
28
7
38
8
12
40
15
4a
5
4
5a
9
6a
42
11
2a
13
18
14
16
3
46
32
2
1
36
6
10

METHOD AND DEVICE FOR INTERMITTENTLY STORING AND RETURNING YARN DURING THE WINDING OF CONICAL BOBBINS FED WITH YARN AT CONSTANT SPEED

The invention relates to a device and method for intermittently storing and returning yarn during the winding of conical bobbins with yarn withdrawn at constant speed from individual spinning units. In said spinning units the yarn is preset at constant speed at the outlet of the feed rollers whereas it is deposited at variable speed between the major diameter and minor diameter of the conical bobbin under formation. In such an operational process it is therefore necessary to periodically vary the length of the yarn path between the feed rollers and its point of deposition on the circumference of the conical bobbin. This length variation and the consequent variation in yarn tension are compensated by adjusting the yarn path by means of a yarn winding tension regulator and compensator device. Tension compensators are known in the art. They comprise a deflecting roller connected to a rocker arm. Depending on the instantaneous yarn tension, or rather according to the instantaneous position of the rocker arm, the mobile deflecting roller is deviated to a varying extent from its contact or bearing position, this position being assumed by the action of a force exerted by a counterweight, a spring or a similar elastic element. These yarn tension compensators have the drawback of exerting an elastic opposing force which cannot be controlled to take account of the tension variations which can occur in the yarn in the case of non-regular storage.

The conical bobbin under foramtion is rotated by a constantly rotating substantially cylindrical drive roller. The dimensions of said bobbin, its taper and the angle of the winding helix determine the angular swing amplitude of the mobile arm.

The swing position of this latter, which keeps a roller connected to it constantly adhering to the yarn, represents the yarn storage value, which constantly increases and decreases according to the stage in the progress of the entire yarn storage and return cycle. Any slippage between the drive roller and bobbin under formation, which frequently occurs due to the friction drive used, increases the length of yarn stored and changes the swign position of the mobile arm which, under the action of the elastic element acting in a pulling capacity, is moved in the limit into an abutting position, consequently nullifying the tension of the yarn being collected. Without tension, this latter winds with irregular turns, so prejudicing the bobbin formation and in the limit the yarn twists about itself to create knows and tangles such as to compromise the yarn consistency.

The tangled yarn also frequently creates obstacles which interrupt yarn continuity, so blocking the spinning process. The high yarn formation rate of spinning units means that any production hold-up in such spining units assumes considerable importance because of the reduced rate of yarn collection on the bobbins.

Yarn tension compensators of this type also have the drawback that if the yarn count or thickness, the type of bobbin under formation or the winding helix angle varies, they have to be adapted to this by onerous manual adjustments to the individual spinning stations, or by replacing the elastic element with another elastic element which conforms to the different operating characteristics. These devices are therfore inflexible in use.

Devices for intermittently storing and returning yarn, preferably for textile machines, are also known. These include by way of example the devices described and claimed in the German patent Nos. DE 1875153 and DE 1454917.

Such devices have numerous drawbacks: they are insensitive to tension and even less to tension variations in the winding yarn because the storage and return element is of a type which, by means of a lever system, is completely controlled by a to-and-fro drive rod which passes along the entire machine face to operate the yarn stores of all the spining untis. They are unable to adjust the yarn tension to one or more predetermined values preset according to the type of yarn being collected or of the bobbin under formation. They present considerable difficulty in adjusting the value preset for the storage of the yarn being wound, as this adjustment must be made manually by an operator by adjusting the length of the connecting rods or the positions of the lever rotation pivots in order to vary the lever arms, and is therefore lengthy, laborious and variable according to the geometrical characteristics of the bobbin under formation and the winding helix angle. They also have a rather high inertia force due to the presence of several lever mechanisms which are mobile simultaneously but intermittently, and tend to trigger uncontrollable vibratory oscillation and at the same time limit the collection rate. They also set limits on the machine length and therefore on the number of spinning units as their operation relies on drive rods which have to extend along the face of the collection units and are subjected ot large numbers of to-and-fro movement strokes. These devices are also rather bulky and inefficient when slippage is present between the conical bobbin under formation and the drive roller. This slippage, which is more or less accentuated, is often present because a conical bobbin being cross-wound continuously rests against a drive roller which on a determined but narrow part of its surface possesses a friction band for friction drive purposes.

A further drawback of such devices is the presence of mobile members, such as rods or shafts, which have to be provided and mounted at the commencement of machine construction, and cannot be fitted later.

Said mobile members control the operation of several storage devices and extend along the entire winding face from a position at the head of the machine. Because of the principle on which they are constructed, these devices are therefore inflexible and unadaptable to preexisting spinning stations or stations not provided with the aforesaid mobile members which pass along the front structure of the entire collection face. An object of the present invention is to obviate the aforesaid drawbacks by providing a yarn storage and intermittent return device wherein yarn is drawn into the storage position and is then released from this storage position (i.e. returned). This returning operation releases the yarn from its storage position and replaces it returns it), to its normal feed path. This device, winding conical bobbins fed with yarn at constant speed has the following advantages:

enables the stored length to be always maintained within a preset range of values with only limited variations in yarn tension allows the immediate takeup of any additional yarn lengths accidentally present due to slippage between the drive roller and conical bobbin under formation does not limit the yarn collection speed in the formation of conical bobbins does not set limits on the machine length and thus does not limit the number of winding units to be positioned side by side, as these do no require for their operation any drive member extending along the entire winding face, and therefore do not possess further masses moving longitudinally to the machine and connected to central drive members does not limit the diameter of the bobbins obtainable and does not require laborious adjustment to be made when changing the taper of the bobbin under formation has extreme operational flexibility such as to allow a range of application which enable soft or compact bobbins to be made up within a vast range of yarn counts without the need for laborious mechanical adjustments can be applied without the need for extensive demounting and remounting of the component parts of the winding machine if this, being already set for forming cylindrical bobbins, is to be converted for forming conical bobbins.

can be easily disengaged so as to make it possible to form both conical and cylindrical bobbins on the same machine. A further object of the present invention is to provide a yarn storage and return device requiring very little maintenance. These and further objects are all attained by the yarn storage and return device of the present invention, in particular for textile machines operating to form conical bobbins, characterised by comprising:

a lever system having two suitably shaped and positioned flat elements, and being able to move with swing motion about an axis by means of a bush positioned as a rigid element joining together said flat elements, of which one acts, in union with a dflecting roller, as a yarn storage and return arm and the other acts as the driven element in the transmission of swing motion originating from a lever driven by a drive source a tension measurer of known type, which measures moment by moment the tension of the yarn being wound in order to generate a corresponding series of electrical signals the values of which are such as to provide at every moment an unambiguous indication of the tension of the winding underway an electronic control unit, in the form of a processor means of known type, which convertes said series of electrical signals into control signals which activate the operation of a drive source a drive source which, under the influence of said control signals, generates a swing movement which moment by moment is regularized in terms of amplitude and position such as to adjust the swing movement of the storage arm to corresponding positions to tension the yarn to a value which is equal or sufficiently close to the value corresponding to regular tension of the winding underway.

According to one embodiment, the device is present individually in each yarn winding position. According to a further embodiment, the device has no mechanical link with the yarn guide element or with the bobbin carrier arm.

The device according to the invention has the advantage, for any variation in the type of yarn and type of bobbin under formation, of automatically adjusting and setting the tension of the yarn being collected such as to operate with regular storage and return swings.

Thus, the yarn is drawn into the storage position when the tension is low and subsequently released from this storage position, i.e. returned, when the tension is high. This returning operation releases the yarn from its storage position and replaces it (returns it), to its normal feed path.

This is a diagrammatic isometric view of the storage and intermittent return device of the present invention cooperating with the yarn guide element, the bobbin under formation being driven by the friction band of the drive roller, the FIGURE showing the moment of maximum storage in the yarn travel while the yarn guide element is moving in the increasing diameter direction of the cross-wound bobbin.

In it: the reference numeral 1 indicates a mobile connection pin for transmitting the swing motion of the flat element 6 to the flat element 2; 2 is a mobile flat element which acts as the transmission element for the motion generated by the drive source 9 and transmitted to the storage and return arm for the yarn being wound; 2a is the position which the flat element 2 assumes at that moment during its swing movement when the stored yarn length 18 is zero or a minimum; 3 is the bush or ring which rigidly joins together the two flat elements 4 and 2 of the storage and return lever system for the yarn being wound; 4 is that flat element which in cooperation with a deflecting roller 5 acts as the storage and return arm for the yarn 18; 4a is the position which the mobile flat element 4 assumes at that moment during its swing movement when the stored yarn length 18 is zero or a minimum; 5 is a yarn deflecting roller or like element which operates as a mobile yarn guide element by moving with swing movement during the storage and return of the yarn 18. it is connected rigidly to the end of the mobile flat element 4 but is free to rotate about itself in order not to generate grazing friction against the yarn 18 under continuous collection movement. It also has a substantially cylindrical profile; 5a is the positon which the mobile yarn deflecting and guide roller 5 assumes at that moment during its swing movement when the stored yarn length 18 is zero or a minimum; 6 is a mobile flat element which is rigidly connected at one end to the drive shaft 10 of the drive source 9 and at its other end to the pin 1 which engages in the slot of the lever 2 for motion transmission purposes; 6a is the position which the mobile flat element 6 assumes during its swing movement when the mobile element 2 is in the position 2a; 7 is an electronic or electromechanical tension measurer or tensiometer of known type able to measure moment by moment the tension of the yarn being wound; 8 is a central unit which combines an electrical comparator with an electronic microprocessor of known type; 9 is drive source which continuously operates a lever system for the storage and return of the yarn 18. Said drive source consists of a pneumatic, hydraulic or electrical actuator or a combination of two or more of these types; 10 is the output drive shaft of the drive source 9, and to which the flat element 6 is rigidly connected; 11 is a fixed yarn deflecting and guide roller having a substantially cylindrical profile and connected rigidly to the base plate 13 but free to rotate about itself to not generate grazing friction against the yarn 18 undergoing continuous collection movement; 12 is a fixed yarn deflecting and guide roller of substantially cylindrical profile connected rigidly to the base plate 15 but free to rotate about itself; 13 is the base plate for the roller 11, and is fixed to the machine structure, not shown on the figure; 15 is the base plate for the roller 12 and is fixed to the machine structure, not shown on the figure; 14 and 16 indicate a pair of rollers positioned along the path of the yarn 18, both rollers being pressed against each other with said yarn 18 passing between them to withdraw it from a spinning unit of a rotor spinning machine and feed it from its outlet towards the compensator device of the present invention at constant speed; 18 is the collected yarn subjected to storage and return at the outlet of the pair of feed rollers 14 and 16; 20 is a solid or hollow shaft of substantially circular or polygonal cross-section which is operated as a control rod for the yarn guide elements 26 by means of a suitably shaped cam so as to transmit a movement of suitable kinematic and dynamic characteristics to said thread guide elements 26; 22 is the drive roller for rotating the conical bobbin 24 under formation; 24 is the cross-wound yarn conical bobbin under formation; 26 is the yarn guide element driven with reciprocating to-and-fro motion by the drive shaft or rod 20, this latter extending along the entire operational winding face; 28 is the friction region in the form of a narrow circular band, for driving a conical bobbin by the drive roller 22; 20 is a blade for deflecting the path of the yarn 18 and can be linear or shaped profile of known type; 32 is the support plate for the pivot 46; 34 is the bobbin carrier arm which supports the yarn package 24 as its diameter increases; 38 is the connection cable between the tension measurer 7 and the central unit 8; 20 is the connection cable between the central unit 8 and the drive source 9; 42 indicates the swing path of the mobile flat element 4; 44 indicates the reciprocating to-and-fro movement path of the shaft 20; 46 is the pivot about which the storage and intermittent return lever system for the yarn 18 swings by way of the bush coupling 3; 48 is the drive shaft which extends along the entire winding face; 36 is the reciprocating path of the movable flat element 6.

The operation of the device according to the invention is as follows.

The purpose of the storage and return device for the yarn 18 being wound onto the conical bobbin 24, according to the invention, is to adapt the varying winding speed deriving from the taper of the bobbin 24 to the constant outlet speed from the feed rollers 14 and 16.

The average winding speed corresponds substantially to the spining speed of the spinning chamber.

When the yarn 19 is being collected on the minor diameter of the bobbin 24 the winding speed is less than the feed speed from the extracting rollers 14 and 16, and the lever system by means of its mobile element 4 stores a suitable length of yarn 18. This stored length is returned gradually as the collection speed increases on moving the yarn towards the major diameter of the bobbin 24 by means of the yarn guide element 26.

The ratio of the minor diameter to the major diameter of the bobbin 24 under formation determines the maximum length of yarn 18 which has to be stored and then returned for each complete transverse cycle of the yarn guide element 26. As said ratio decreases continuously with increasing fullness of the bobbin 24 under formation, the amplitude of the swing movement of the mobile yarn deflecting and guide roller 5 also decreases for decreasing storage of yarn 18. The mobile deflecting roller 5 generates a loop by deflecting the yarn 18 from its path. This loop therefore has a continuously varying amplitude and the device of the present invention automatically controls this loop by acting as a compensator for the periodic tension variations which arise as a result of the periodic winding speed variations in the formation of a conical bobbin 24.

In order to compensate said tension variations to which the collected yarn 18 is subjected and level them out to a substantially constant value, the mobile deflecting roller 5 has to assume different positions relative to the fixed deflecting rollers 11 and 12. Because of the rigid connection, this variation in the position of the mobile deflecting roller 5 corresponds to the swing of the two flat elements 4 and 2.

The flat element 2 acts as the driven element in the transmission of swing motion originating from the flat mobile element 6 which is rigidly connected to the drive shaft 10 of the drive source 9. The pin 1 represents the element which engages with the slot in the element 2 in order to transmit the swing motion between the two flat elements 6 and 2. The effect of the periodic variation in the speed of winding the yarn 19 onto the conical bobbin 24 is a variation in yarn tension. This latter tension variation is stabilised at a certain value by the swing positions of the flat element 4 and storage roller 5 which guides and accompanies the yarn 18 so tensioning it during the intermittent storage and return stages. The deflection of the stored yarn therefore depends at any moment on the tension of the winding underway. The tension measurer 7 measures the tension of the yarn 19 at the commencement of winding and generates corresponding proportional electrical signals which are fed to the control unit 9, this then processing them to convert them to control signals which activate the drive source 9. This latter, under the action of said control signals, produces swing motion along the line 36 having the amplitude, position and frequency necessary to obtain a practically constant yarn tension. Said value, as measured by the tension measurer 7 and known hereinafter as the regular value, depends on the type of bobbin under formation. The swing motion defined by the line 36 is transmitted rigidly to the mobile deflecting roller 5 in accordance with the lever ratios, and is repeated continuously and constantly until the tension measure 7 measures a tension which is regular or sufficiently close thereto.

If the yarn tension assumes a value outside the limits of the regular range, the electronic control unit 8 receives electrical signals from the tension measurer and instantly generates control signals for the drive source 9. This latter adjusts the swing motion to a slightly different amplitude and position than its previous state so as to correspondingly adjust the swing of the storage and return roller 5 and restore the tension of the yarn 18 to a value equal or sufficiently close to the regular tension value for the winding underway.

From the description it is apparent that the invention attains the set objects. The various processed signals can obviously be functions of other physical quantities related to the aforesaid, as the arrangement of the various units of the device can be easily modified according to the types of quantities to be processed or compared.

The invention so conceived is susceptible to numerous modifications, all of which fall within the scope of the inventive concept. In addition, all details can be replaced with other technically equivalent elements; all without leaving the scope of the inventive idea as claimed hereinafter.

We claim:

1. A yarn storage and return device for yarn being wound on a conical bobbin driven at a constant speed comprising:

(a) a lever system including a shaft and a pair of arms, which are connected to and move with each other, through which said shaft passes, and which can swing around the axis defined by said shaft, wherein said pair of arms includes a first arm having a deflecting roller acting as a yarn storage and return means and a second arm acting as a driven element for transmitting a swing motion;

(b) a sensor for measuring the tension of yarn to be wound on the bobbin for generating a series of corresponding electrical signals for indicating the tension thereof;

(c) an electronic control processor unit for converting said series of electrical signals from said sensor into control signals; and (d) a drive source activated by said control signals from said electronic control processor unit for generating a constantly regulated swing movement and connected by an articulated means to said driven element to adjust the movement of the storage arm for restoring the yarn tension to within a predetermined preset tension range.

2. In an apparatus for winding yarn on a conical bobbin driven at a constant speed, including a guide for guiding the yarn onto the bobbin and a support for supporting the bobbin, a device for storing and returning yarn being wound on the bobbin independent of said guide and said support, wherein the device comprises:

(a) a lever system including a shaft and a pair of spaced apart arms which are rigidly joined by a bushing, through which said shaft passes, and which can swing around the axis defined by said shaft, wherein said pair of arms includes a first arm having a deflecting roller acting as a yarn storage and return means and a second arm acting as a driven element for transmitting a swing motion;

(b) a sensor for measuring the tension of yarn to be wound on the bobbin for generating a series of corresponding electrical signals for indicating the tension thereof;

(c) an electronic control processor unit for converting said series of electrical signals from said sensor into control signals; and (d) a drive source activated by said control signals from said electronic control processor unit for generating a constantly regulated swing movement and connected by an articulated means to said driven element to adjust the movement of the storage arm for restoring the yarn tension to within a predetermined preset tension range.

3. A method for storing and returning yarn being wound on a conical bobbin driven at a constant speed comprising the steps of:

(a) driving a lever system means having a storage and return arm means and a driven element means for storing and returning yarn and transmitting a swing motion to said lever system means;

(b) measuring the tension of the yarn to be wound on the bobbin and generating a series of corresponding electrical signals for indicating said yarn tension by a tension sensor means;

(c) converting said series of electrical signals from said tension sensor means by comparing said electrical signals with a predetermined preset tension range and generating control signals by an electronic control processor unit means; and (d) generating a constantly regulated swing movement by adjusting the movement of said driven element means of said lever system means for varying the movement of said storage and return arm means of said lever system means for restoring the yarn tension to within the preset tension range by a drive source means according to said control signal from said electronic control processor unit means.

* * * * *